US011407235B2

(12) United States Patent
Cuner Utges et al.

(10) Patent No.: US 11,407,235 B2
(45) Date of Patent: Aug. 9, 2022

(54) VINYL SUBSTRATE PRINTING

(71) Applicant: HEWLETT-PACKARD DEVELOPMENT COMPANY, L.P., Spring, TX (US)

(72) Inventors: Josep Maria Cuner Utges, Sant Cugat del Valles (ES); Aleix Fort Filgueira, Sant Cugat del Valles (ES); Alejandro Mielgo Barba, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,567

(22) PCT Filed: Jun. 25, 2018

(86) PCT No.: PCT/US2018/039341
§ 371 (c)(1),
(2) Date: Oct. 7, 2019

(87) PCT Pub. No.: WO2020/005201
PCT Pub. Date: Jan. 2, 2020

(65) Prior Publication Data

US 2021/0331492 A1 Oct. 28, 2021

(51) Int. Cl.

| | |
|---|---|
| ***B41J 11/00*** | (2006.01) |
| ***B41M 1/30*** | (2006.01) |
| ***B41J 29/377*** | (2006.01) |
| ***B41M 5/00*** | (2006.01) |

(52) U.S. Cl.
CPC ..... *B41J 11/002* (2013.01); *B41J 11/00244* (2021.01); *B41J 29/377* (2013.01); *B41M 1/30* (2013.01); *B41M 5/0011* (2013.01); *B41M 5/0047* (2013.01); *B41M 5/0064* (2013.01)

(58) Field of Classification Search
CPC ..... B41J 11/00244; B41J 11/0015; B41J 11/0022; B41J 11/0024
See application file for complete search history.

(56) References Cited

U.S. PATENT DOCUMENTS

| | | | |
|---|---|---|---|
| 4,466,813 | A | 8/1984 | Avritt et al. |
| 5,287,123 | A | 2/1994 | Medin |
| 5,406,316 | A | 4/1995 | Schwiebert et al. |
| 6,063,899 | A | 5/2000 | Johnson et al. |
| 6,223,449 | B1 | 5/2001 | Johnson et al. |
| 6,332,679 | B1 | 12/2001 | Higuma et al. |
| 6,785,501 | B2 | 8/2004 | Hongawa et al. |

(Continued)

FOREIGN PATENT DOCUMENTS

| | | | | |
|---|---|---|---|---|
| EP | 1228890 | A2 | 8/2002 | |
| EP | 2730419 | A1 * | 5/2014 | ..... B41J 11/00244 |
| WO | WO2018022018 | A1 | 2/2018 | |

*Primary Examiner* — Leslie J Evanisko
(74) *Attorney, Agent, or Firm* — HP Inc. Patent Department

(57) ABSTRACT

The present disclosure relates to vinyl substrate printing. In an example, a vinyl printing apparatus is disclosed wherein the apparatus comprises a media path to convey a vinyl substrate along a feed direction from a substrate supply to a print zone; an inkjet printhead to print on the print substrate at the print zone; and a heater upstream of the print zone to heat the print substrate to evaporate a plasticizer from a surface of the print substrate.

20 Claims, 3 Drawing Sheets

(56) References Cited

U.S. PATENT DOCUMENTS

| | | | | |
|---|---|---|---|---|
| 7,769,311 | B2 | 8/2010 | Tsubaki | |
| 2011/0063374 | A1* | 3/2011 | Rea | B41J 11/00242 347/56 |
| 2012/0050372 | A1* | 3/2012 | Yamaguchi | B41J 29/38 347/16 |
| 2014/0368590 | A1* | 12/2014 | Shima | B41J 11/002 347/102 |
| 2015/0336404 | A1* | 11/2015 | Sasaki | B41J 11/0024 347/101 |
| 2016/0144634 | A1 | 5/2016 | Emamjomeh et al. | |

* cited by examiner

VINYL SUBSTRATE PRINTING

BACKGROUND

Some printing media, such as self-adhesive vinyl and Poly Vinyl Chloride (PVC) banner material, may include a plasticizer to soften the media to make it flexible and thereby improve the ease of printing on the material.

Plasticizers in the media tend to migrate to the surface of the media over time creating an uneven distribution of plasticizers over the media surface.

This migration affects the image quality produced when printing on the media, and may particularly affect image quality when using latex ink technology, because the surface tension of the media is modified by the presence of the plasticizers, thereby producing image quality defects such as grain, coalescence and poorer quality optical density.

BRIEF DESCRIPTION OF DRAWINGS

Some non-limiting examples of the present disclosure will be described in the following with reference to the appended drawings, in which.

DETAILED DESCRIPTION

In implementations disclosed herein, a printing quality achieved by a vinyl printing apparatus is improved by heating the vinyl print substrate upstream of the heating zone to evaporate plasticizers that may have migrated to the surface of the print substrate.

Figure 1:
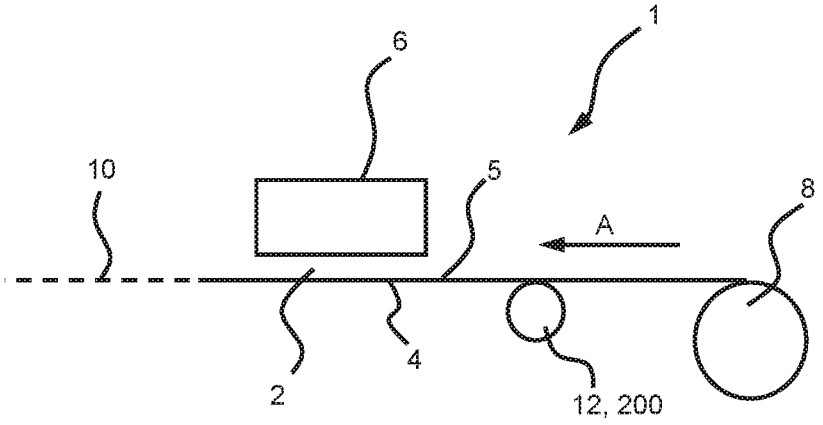
FIG. 1 is a simplified schematic view of an example of a printing apparatus; a FIG. 2 is a simplified schematic cross-sectional view of an example of a heater for a printing apparatus.

With reference to FIG. 1, an example of a vinyl printing apparatus 1 to print on a vinyl print substrate 4 comprises a print zone 2, where a printing liquid, such as a latex containing ink, may be deposited on a printing surface 5 of the print substrate 4, by a printhead 6. In the example shown in FIG. 1, the printhead 6 is an inkjet printhead, nonetheless, in other examples, the printhead 6 may be, e.g., a piezo printhead.

The printing apparatus 1 further comprises a substrate supply 8 from which the print substrate is conveyed along a media path 10 to the print zone 2 in a direction A. In the example shown, the print substrate supply comprises an input media roller about which the print substrate 4 is provided in the form of a roll. The print substrate 4 is unrolled from the input media roller as the print substrate 4 is conveyed along the media path 10. In other examples, the print substrate supply 8 may comprise any other suitable source of print media, such as a tray containing sheets of print substrate, or an inlet for receiving a web or sheets of print media.

According to examples of the present disclosure, the printing apparatus 1 further comprises a heater 12 to evaporate a plasticizer from a surface of the print substrate, e.g. the printing surface 5. The heater 12 is positioned upstream of the print zone 2, e.g. with respect to the conveyance of the print substrate 4. In the example shown in FIG. 1, the heater 12 comprises a heated roller 200, which is described in more detail with reference to FIG. 2 below. However, in other examples, the heater 12 may comprise any other heater suitable for heating the printing media upstream of the print zone 2.

In the example depicted, the heater 12 is to heat the print substrate 4 via thermal conduction, e.g. by virtue of direct contact between the print substrate 4 and the heater 12. The heater 12 is therefore arranged relative to the media path 10 such that the print substrate 4 passes the heater 12 in contact with the heater 12 as it is conveyed along the media path 10 (for example, adjacent, below, over, or between a pair of heaters).

In other examples, the heater 12 may be to heat the print substrate via convective heating and/or radiation heating. For example, the heater may comprise a heating element, and may further comprise a fan for passing air heater by the heating element over the print substrate 4. In such examples, the print substrate 4 may not contact the heater as the print substrate is conveyed along the media path 10. A contact heater may provide more uniform and predictable heating along the width and length of the substrate than other types of heaters. A roller contact heater may compact both in respect of its own space claim within the apparatus, and because it may take the place of a redirecting roller.

In the example shown in FIG. 1, the heater 12, or a portion of the heater 12, is rotatably mounted in the printing apparatus 1 so that the heater, or portion thereof, can rotate as the print substrate 4 passes over the heater 12. In this way, the tangential velocity of the surface of the heater 12 contacting the print substrate 4 may be substantially equal to the velocity of the print substrate 4 along the media path. In other words, the heater 12, or portion thereof, may rotate such that there is no or minimal slipping of the print substrate 4 relative to the surface of the heater 12. Reducing slipping of the print substrate 4 over the heater 12 may reduce friction between the print substrate 4 and the heater 12 as the print substrate 4 is conveyed along the media path 10, which may mitigate against print image quality defects. The heater 12, or portion thereof, may rotate freely or may be rotatably driven so that the surface of the heater 12 has a target relative velocity relative to the print substrate 4, such as zero relative velocity.

In other examples of the vinyl printing apparatus 1, the print substrate 4 may slip relative to the surface of the heater 12 as the print substrate 4 passes over the heater 12. For example, the heater 12 may be fixedly mounted relative to the media path 10 such that the outer surface of the heater 12 is stationary relative to the media path 10.

The heater 12 is to heat the print substrate 4 to a temperature at which the plasticizer, e.g. at least a portion of the plasticizer present at the surface 5 of the print substrate 4, evaporates. The temperature at which the plasticizer evaporates depends on the material of the print substrate 4. For example, the temperature at which the plasticizer evaporates may be greater than or equal to 50° C. At temperatures greater than 120° C. the material of the print substrate 4 may be negatively affected, for example, by creating thermal deformation, such as wrinkles, which may cause print quality defects and may cause damage to the print system (e.g. due to substrate jams or thermal stress of the printheads). The heater 12 may therefore be to heat the print substrate 4 to a temperature less than or equal to 120° C. In one example, the heater 12 is to heat the print substrate 4 to approximately 70° C. References herein to heating the print substrate 4 to a threshold temperature relate to the print surface 5 of the print substrate 4 being heated to that temperature. In the present example, the heater 12 is provided on the opposite side of the print substrate 4 to the print surface.

Figure 2:
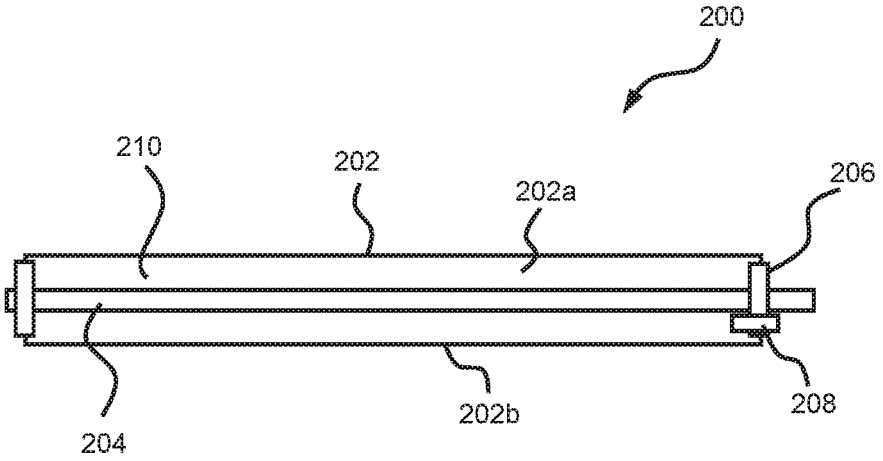

With reference to FIG. 2, an example of the heater 12, which comprises the heated roller 200 will now be described. The heated roller 200 comprises a hollow roller body 202 and a heating element 204. The heating element 204 is positioned at least partly within a cavity 202*a* inside the hollow roller body 202. In the example shown, the hollow roller body 202 is substantially cylindrical in shape and has a substantially constant circular cross-section along its length, e.g. in a longitudinal direction of the hollow roller body 202. However, in other examples, the hollow roller body 202 may have any other cross-sectional shape. Furthermore, the cross-sectional shape may vary along the longitudinal length of the hollow roller body 202.

In the example shown, the hollow roller body 202 is rotatably mounted on the heating element 204, e.g. via rotary supports 206 that permit relative rotation between the hollow roller body 202 and the heating element 204, so that the hollow roller body 202 can rotate as the print substrate 4 passes over the heater. In this way, the heated roller 200 reduces slipping of the print substrate 4 relative to the outer surface of the hollow roller body 202 as the print substrate 4 passes over the heated roller 200.

In other arrangements, the hollow roller body 202 may be otherwise mounted on the printing apparatus 1 so that it is rotatable relative to the heating element 204, or the heating element 204 may rotate together with the hollow roller body 202.

The heating element 204 may comprise a resistive element that becomes hot when an electric current is passed through the element. Heat may be transferred from the heating element 204 to an outer wall 202*b*, e.g. shell, of the hollow roller body 202 through any of thermal conduction, convection and radiation between the heating element 204 and the hollow roller body 202. In other examples, a heating element may be external to the roller, for example, an external heating element may heat the roller at a position away from where the roller contacts the print substrate. The heating element may be to heat the roller by any of thermal conduction, convection (e.g. with a fan directed to the surface of the roller), and radiation.

A heat transfer material 210, such as a heat transfer fluid, may be provided within the cavity 202*a* of the hollow roller body 202. The heat transfer material 210 may have a greater heat transfer coefficient, e.g. conductive heat transfer coefficient, than air, such that the presence of the heat transfer material improves transfer of heat from the heating element 204 to the outer wall 202*b* of the hollow roller body 202 (e.g. compared to an example in which air is used instead of such a heat transfer material 210 is not provided). The heat transfer fluid may be a liquid, such as an oil.

Figure 3:
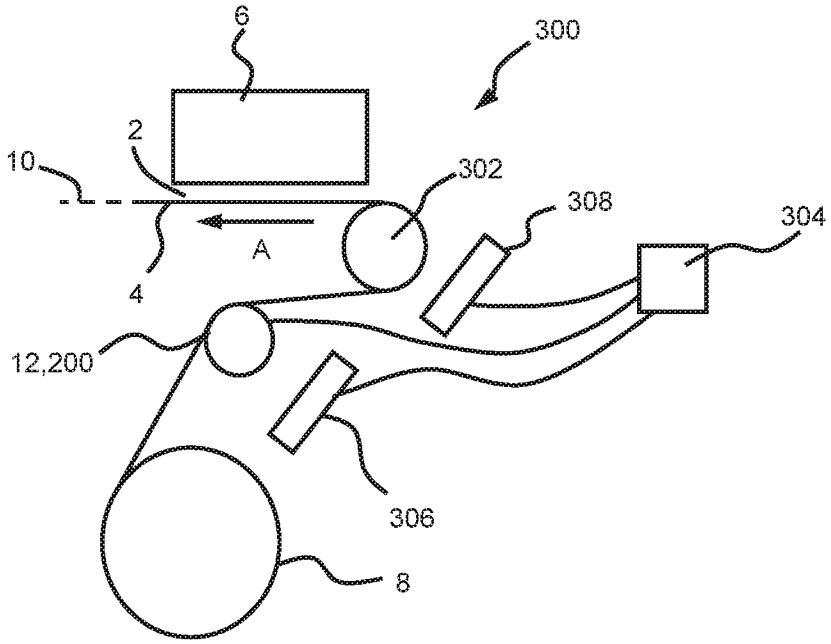
FIG. 3 is a simplified schematic view of another example of a printing apparatus.

The heated roller 200 may further comprise a temperature sensor 208 to measure a temperature of the heated roller 200, e.g. of the heating element 204, outer wall 202*b* and/or heat transfer material 210. As described below, the temperature measured by the temperature sensor 208 may be used to control the operation of the heating element 204, e.g. in order to heat the heated roller 200 or print substrate 4 to a target temperature, FIG. 3 shows a further example of a vinyl printing apparatus 300 comprising a print zone 2, a printhead 6, a print substrate supply 8, from which a print substrate 4 is conveyed along a media path 10, substantially as described above with reference to FIG. 1. In the example of the vinyl printing apparatus 300 shown in FIG. 3, the heater 12 comprises the heating roller 200 described above with reference to FIG. 2. However, in further examples, any other form of heater 12 may be provided together with the other features shown in FIG. 3 and described herein.

The example of the vinyl printing apparatus 300 shown in FIG. 3 further comprises a media advance roller 302 to convey and redirect the print substrate 4 from the print substrate supply 8 over the heated roller 200 and to the print zone 2. As shown, the media advance roller 302 may be positioned downstream of the heating roller, e.g. with respect to the conveyance of the print substrate 4.

The vinyl printing apparatus 300 further comprises a controller 304 for controlling the operation of the vinyl printing apparatus 300. In particular, the controller 304 may control the operation of the heated roller 200, e.g. by controlling a control signal that is to determine a characteristic of the heater, for example a voltage provided to the heating element 204, or a control signal to activate or deactivate the heater. When the heated roller 200 comprises a temperature sensor 208 as described above, the controller 304 may determine the temperature of the heated roller 200 using the temperature sensor 208. The controller 304 may control the operation of the heated roller 200, e.g. the temperature to which the heated roller 200 is heated, using closed loop feedback control based on the temperature from the temperature sensor 208. For example, the controller 304 may apply proportional, integral and/or differential feedback control to control the operation of the heated roller 200. In another example, the controller 304 may control the operation of the heated roller 200 using open loop control.

As described above, the temperature to which the print substrate 4 is heated, in order to evaporate the plasticizer, may depend on the material of the print substrate 4. A user of the vinyl printing apparatus 300 may select a temperature for the print substrate 4 to be heated to when operating the vinyl printing apparatus 300, or may select a mode of heating control which corresponds to such a temperature. In other examples, the controller 304 may receive a media profile setting, e.g. from the user or another controller. The media profile setting may comprise information relating to material of the print substrate 4. The controller 304 may determine the temperature to which print substrate 4 should be heated, or to which the heated roller should be heated, or a power to be supplied to the heated roller, based on the information within the media profile setting. In other example, the media profile setting may comprise information relating to the temperature to which the print substrate 4 or the heated roller 200 should be heated, or the power which should be supplied to the heated roller, and the controller 304 may control the operation of the heated roller 200 accordingly. A temperature to which the heated roller is heated, or a power which is to be supplied to the heated roller, may be varied (e.g. by the controller) in dependence on the type of print substrate and a feed rate selected for a printing operation. For example, when a higher feed rate is selected, a higher heater power may be provided in order to heat the print substrate to the same temperature.

In certain circumstances, e.g. when a certain type of print substrate 4 is being printed on, heating the print substrate 4 may have an adverse effect, e.g. on print image quality. If such circumstances arise whilst the heated roller 200 is hot, e.g. above a threshold temperature, the heated roller 200 may be cooled in order to reduce heating of the print substrate 4.

As shown in FIG. 3, in some examples the vinyl printing apparatus 300 comprises a cooler 306 to cool the heater 12. In the example depicted, the cooler 306 comprises a fan to blow air over the heated roller 200. However, in other arrangements, the cooler 306 may comprise a pump for pumping a coolant fluid through a cooling duct arranged in contact with the heated roller 200, or a thermoelectric cooling device in contact with the heated roller 200. The controller 304 may control the operation of the cooler 306 to control the temperature of the heated roller 200, e.g. according to user input or the media profile setting.

To further improve print image quality, the print apparatus 300 may be configured and/or operated so that the print substrate 4 is at a temperature within a target printing temperature range when the print substrate 4 reaches the print zone 2. The target printing temperature range may be less than the temperature at which the plasticizer evaporates or a temperature to which the print substrate is heated by the heater 12. For example, the target printing temperature range may be between 30° C. and 50° C. or between 30° C. and 40° C. The print substrate 4 may therefore be cooled between the heated roller 200 and the print zone (i.e. at a position between them with respect to the conveyance of the print substrate 4).

In some examples, the heater 12 may be spaced apart from the print zone 2 along the media path 10 of the vinyl printing apparatus 300 by a distance that is sufficient for the print substrate 4 to cool to a temperature within the target printing temperature range before reaching the print zone 2.

In another example, as depicted in FIG. 3, the vinyl printing apparatus 300 may comprise a substrate cooler 308 to cool the print substrate between, e.g. at a position between, the heater 12 and the print zone 2. The controller 304 may control the operation of the print substrate cooler 308, e.g. based on a user input and/or based on a media profile setting.

Figure 4:
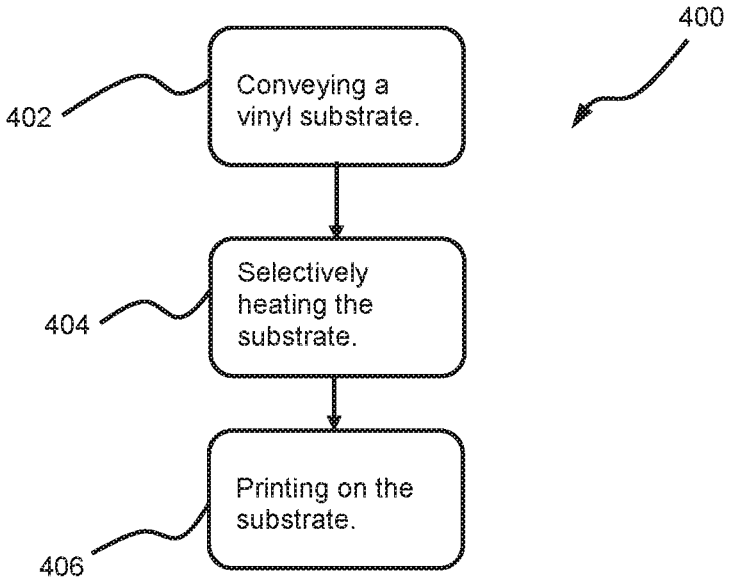
FIG. 4 is a flowchart illustrating an example of a method for printing.

With reference to FIG. 4, an example method 400 of printing, e.g. using the vinyl printing apparatus 1, 300, will now be described. In this example, the vinyl printing apparatus is loaded with a print substrate comprising PVC containing a plasticizer additive (e.g. the print substrate supply 8 of the vinyl printing apparatus). The method 400 may be performed using the controller 304 or another controller—such as an external controller.

In block 402, the vinyl print substrate 4 is conveyed along the media path 10 from the print substrate supply 8 to the print zone 2. In block 404, the print substrate 4 is heated (e.g. selectively heated) upstream of the print zone 2 to evaporate the plasticizer from the surface 5 of the print substrate 4. As described above, the print substrate 4 may be heated using the heater 12, e.g. a heated roller 200. The controller controls operation of the heater 12 as described above.

In block 406, the print substrate 4 is printed on at the print zone using the printhead 6. In one example, the vinyl substrate is printed on using an inkjet printhead depositing a latex ink on the vinyl substrate.

Figure 5:
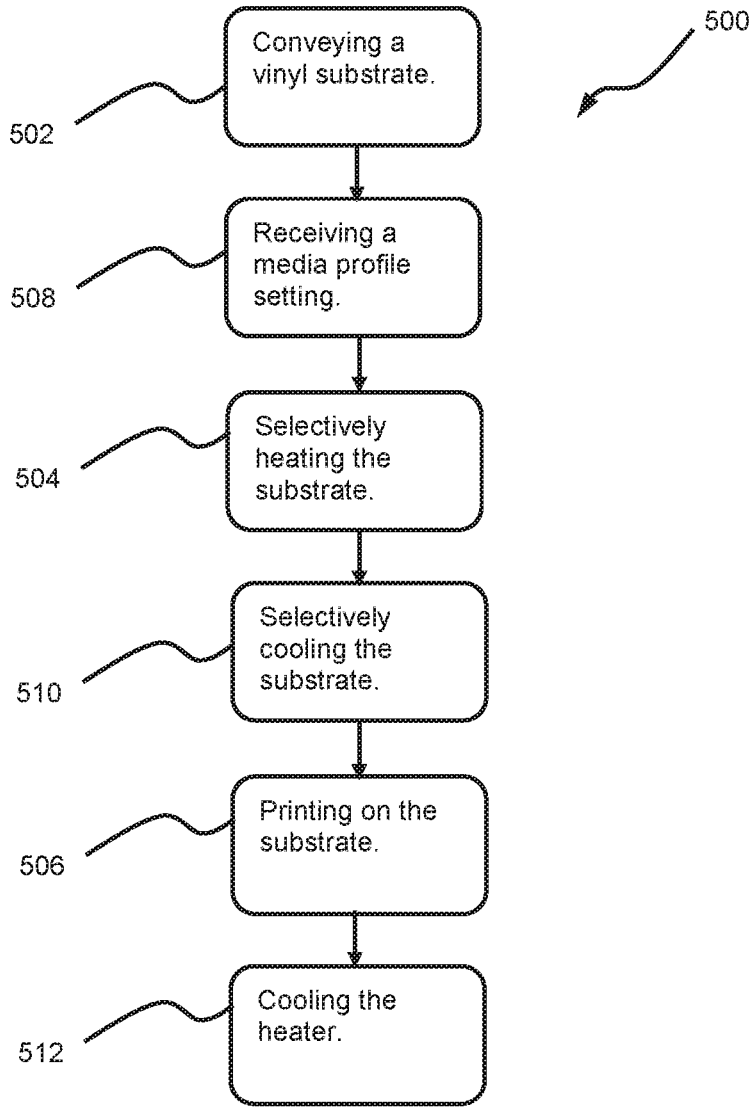
FIG. 5 is a flowchart illustrating another example of a method for printing.

With reference to FIG. 5, another example of a method 500 of printing will be described, by way of example only, with reference to use of the vinyl printing apparatus 300. At block 502, the vinyl substrate is conveyed along the media path 10 from the print substrate supply 8 to the print zone 2. At block 504, the print substrate is heated, e.g. selectively heated, upstream of the print zone 2 to evaporate the plasticizer from the surface 5 of the print substrate 4. At block 506, the print substrate 4 is printed on at the print zone 2 using the printhead 6.

When the heater 12 comprises the heated roller 200 having the temperature sensor 208, the operation of the heater 12 at block 504 may be controlled using open loop or closed loop feedback control. The controller 304, or other controller, may apply proportional, integral and/or derivative control when controlling the operation of the heater 12.

At block 508, a media profile setting is received, e.g. by the controller 304 or other controller performing the method 500. The media profile setting may define a property of the material of the print substrate 4. For example, the media profile setting may comprise information defining the type of print substrate 4 (e.g. a substrate comprising PVC containing a plasticizer additive). The controller 304, or other controller, may determine whether the print substrate should be heated based on the media profile setting. In some examples, the power of the heater or a temperature to which the print substrate 4 or the heater should be heated in order to evaporate the plasticizer may be determined based on the definition of the print substrate 4 provided within the media profile setting. For example, the controller 304 may refer to a database or look-up table relating print substrate materials to temperatures stored in a memory associated with the controller 304. In another example, the media profile setting may define the power of the heater or the temperature to which the print substrate 4 or the heater should be heated in order to evaporate the plasticizer and the controller 304 may control the operation of the heater 12 accordingly.

At block 510, the print substrate 4 is cooled, e.g. selectively cooled, between the heater and the print zone 2. For example, the print substrate 4 may be cooled using the substrate cooler 308 or another cooling device provided on the vinyl printing apparatus 300.

The controller 304, or other controller, may determine whether the print substrate 4 should be cooled based on the media profile setting, e.g. based on the material definition of the print substrate 4 provided within the media profile setting. It may be determined whether to cool the print substrate 4 based on the temperature to which the print substrate 4 has been heated in order to evaporate the plasticizer and/or based on the target printing temperature range. The target printing temperature range may be determined based on the print substrate 4, e.g. the material definition of the print substrate, and/or properties of the vinyl printing apparatus 300, e.g. the printhead 6.

At block 512, the heater 12, e.g. the heated roller 200, is cooled. The heater 12 may be cooled in order to reduce heating of the print substrate 4 by the heater, e.g. if heating the print substrate 4 may have an adverse effect. For example, the heater 12 may be cooled by the fan 306 or another cooling device.

The controller 304, or other controller, may determine whether to cool the heater based on the power of the heater or the temperature of the heater, and/or based on the media profile setting received by the controller 304. For example, if a media profile setting is received which indicates that a new print substrate 4 should be heated to a temperature less than a previous substrate 4 (i.e. in an immediately previous printing operation) the controller 304 may cool the heater 12.

Figure 6:
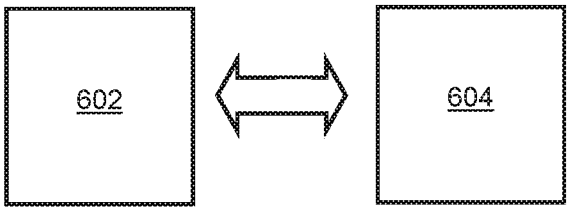
FIG. 6 is a schematic view showing a machine readable medium and a processor.

FIG. 6 shows a non-transitory machine-readable medium 602 encoded with instructions executable by a processor 604. In an example, the instructions include instructions to convey the vinyl substrate 4 along a media path from a substrate supply to a print zone; print on the print substrate at the print zone using an inkjet printhead; and selectively heat the print substrate upstream of the print zone to evaporate a plasticizer from a surface of the print substrate as described above with respect to the method 400 depicted in the flowchart of FIG. 4.

In other example, the machine-readable medium 602 may be encoded with instructions executable by the processor 604 which are executable by the processor 604 in order to perform blocks of the method 500 described above with reference to FIG. 5.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A vinyl printing apparatus to print on a vinyl substrate comprising:

a media path to convey a vinyl substrate along a feed direction from a substrate supply to a print zone;

a printhead to print on the substrate at the print zone; and a heater upstream of the print zone configured to evaporate a plasticizer from a surface of the substrate prior to the substrate reaching the print zone by heating the substrate to a temperature of 50° C. or more, wherein the heater is spaced apart from the print zone along the media path by a distance such that the substrate heated by the heater to the temperature of 50° C. or more cools to a target temperature between 30° C. and 50° C. when reaching the print zone and when the printhead prints on the substrate.

2. The vinyl printing apparatus according to claim 1, wherein the heater is spaced apart from the print zone along the media path by the distance such that the substrate heated by the heater cools to the target temperature between 30° C. and 40° C. when reaching the print zone and when the printhead prints on the substrate.

3. The vinyl printing apparatus of claim 1, wherein the heater is to heat the vinyl substrate to the temperature of 70° C. before reaching the print zone.

4. The vinyl printing apparatus according to a claim 1, wherein the heater comprises a heated roller to contact the vinyl substrate being conveyed along the media path.

5. The vinyl printing apparatus of claim 4, wherein the heater comprises a heating element to heat the roller, wherein the roller is to rotate about the heating element.

6. The vinyl printing apparatus of claim 4, wherein the roller comprises a hollow roller body and a heat transfer fluid provided within a cavity of the hollow body.

7. The vinyl printing apparatus according to claim 1, wherein the apparatus further comprises a media advance roller downstream of the heater.

8. The vinyl printing apparatus of claim 1, wherein the apparatus comprises a controller to receive a media profile setting and control the operation of the heater according to the media profile setting.

9. A method comprising:

conveying a vinyl substrate along a media path from a substrate supply to a print zone;

printing on the substrate at the print zone using an inkjet printhead; and evaporating a plasticizer from a surface of the substrate prior to the substrate reaching the print zone by heating the substrate at a location between the substrate supply and the print zone upstream of the print zone using a heater.

10. The method of claim 9, wherein the method further comprises:

cooling the substrate after the plasticizer has been evaporated to a target temperature within a target printing temperature range when the substrate is printed on at the print zone by spacing the heater apart from the print zone along the media path by a distance sufficient for the substrate to cool to the target temperature between being heated and reaching the print zone.

11. The method of claim 10, wherein the target printing temperature range to which the substrate cools when reaching the print zone is between 30° C. and 50° C.

12. The method of claim 10, wherein the target printing temperature range is between 30° C. and 40° C.

13. The method of claim 9, wherein the method further comprises:

receiving a media profile setting defining a property of the material of the substrate; and determining whether the substrate should be heated based on the media profile setting.

14. The method of claim 9, wherein the substrate is heated to a temperature of 50° C. or more before reaching the print zone.

15. The method of claim 9, wherein the substrate is heated to the temperature of 70° C. before reaching the print zone.

16. A non-transitory machine-readable medium encoded with instructions executable by a processor and comprising instructions to:

control a printing apparatus to convey a vinyl substrate along a media path from a substrate supply to a print zone;

control the printing apparatus to print on the substrate at the print zone using an inkjet printhead; and control a heater to evaporate a plasticizer from a surface of the substrate prior to the substrate reaching the print zone by heating the substrate upstream of the print zone.

17. The non-transitory machine-readable medium of claim 16, wherein the substrate is heated to a temperature of 50° C. or more before reaching the print zone.

18. The non-transitory machine-readable medium of claim 16, wherein the substrate is heated to the temperature of 70° C. before reaching the print zone.

19. The non-transitory machine-readable medium of claim 16, wherein the heater is spaced apart from the print zone along the media path by a distance sufficient for the substrate to cool to a target temperature between being heated and reaching the print zone.

20. The non-transitory machine-readable medium of claim 19, wherein the target temperature to which the substrate cools when reaching the print zone is between 30° C. and 40° C.

* * * * *